US009464815B2

(12) United States Patent
Uselton

(10) Patent No.: US 9,464,815 B2
(45) Date of Patent: Oct. 11, 2016

(54) HVAC SYSTEMS AND METHODS WITH IMPROVED HUMIDITY REGULATION

(71) Applicant: Lennox Industries Inc., Richardson, TX (US)

(72) Inventor: Robert B. Uselton, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 221 days.

(21) Appl. No.: 14/533,082

(22) Filed: Nov. 4, 2014

(65) Prior Publication Data

US 2016/0123610 A1 May 5, 2016

(51) Int. Cl.
*F24F 3/14* (2006.01)

(52) U.S. Cl.
CPC ..... *F24F 3/1417* (2013.01); *F24F 3/1429* (2013.01); *F24F 2003/1435* (2013.01)

(58) Field of Classification Search
CPC ..... F24F 3/1417; F24F 3/1429; F24F 2003/1435
See application file for complete search history.

(56) References Cited

U.S. PATENT DOCUMENTS 6,216,489 B1 4/2001 Potnis et al.
2006/0150665 A1* 7/2006 Weimer ..... F25B 15/14 62/476
2013/0056177 A1 3/2013 Coutu et al.
2014/0245772 A1* 9/2014 Gerlach ..... F24F 3/1411 62/271

FOREIGN PATENT DOCUMENTS

WO 2011/161547 A2 12/2011
WO 2011/161547 A3 12/2011

OTHER PUBLICATIONS

Partial European Search Report received in European Patent Application No. 15190352.3, dated Apr. 21, 2016, 6 pages.
"About 7AC Technologies," http://www.7actech.com/site/index-1.html, printed on Nov. 3, 2014, 1 page.

* cited by examiner

*Primary Examiner* — Emmanuel Duke
(74) *Attorney, Agent, or Firm* — R. Johnston Law, PLLC

(57) ABSTRACT

Systems, devices, and methods are presented for using a liquid desiccant to regulate a moisture content of air conditioned by a heating, ventilating, and air conditioning (HVAC) system. The liquid desiccant is disposed within a processing volume, which is substantially-enclosed and substantially segregates the liquid desiccant from the conditioned air. A pair of vapor-permeable membranes define opposite surfaces of the processing volume. Water vapor diffuses through the vapor-permeable membranes, thereby enabling an exchange of moisture between the liquid desiccant and the conditioned air. The refrigerant circuit itself is used to cool desiccant in the absorber and heat desiccant in the desorber. Other systems, devices, and methods are presented.

16 Claims, 2 Drawing Sheets

HVAC SYSTEMS AND METHODS WITH IMPROVED HUMIDITY REGULATION

TECHNICAL FIELD

The present disclosure relates generally to heating, ventilating, and air conditioning (HVAC) systems, and more particularly, to HVAC systems and methods with improved humidity regulation.

BACKGROUND

Heating, ventilating, and air conditioning (HVAC) systems can be used to regulate the environment within a conditioned space. Typically, an air blower is used to pull air (i.e., return air) from the conditioned space into the HVAC system through ducts and push the air into the conditioned space through additional ducts after conditioning the air (e.g., heating, cooling, or dehumidifying the air). The dehumidifying aspect of an HVAC system may utilize a moisture-altering device that includes a liquid desiccant.

BRIEF DESCRIPTION OF THE DRAWINGS

Illustrative embodiments of the present disclosure are described in detail below with reference to the attached drawing figures, which are incorporated by reference herein.

Figure 1:
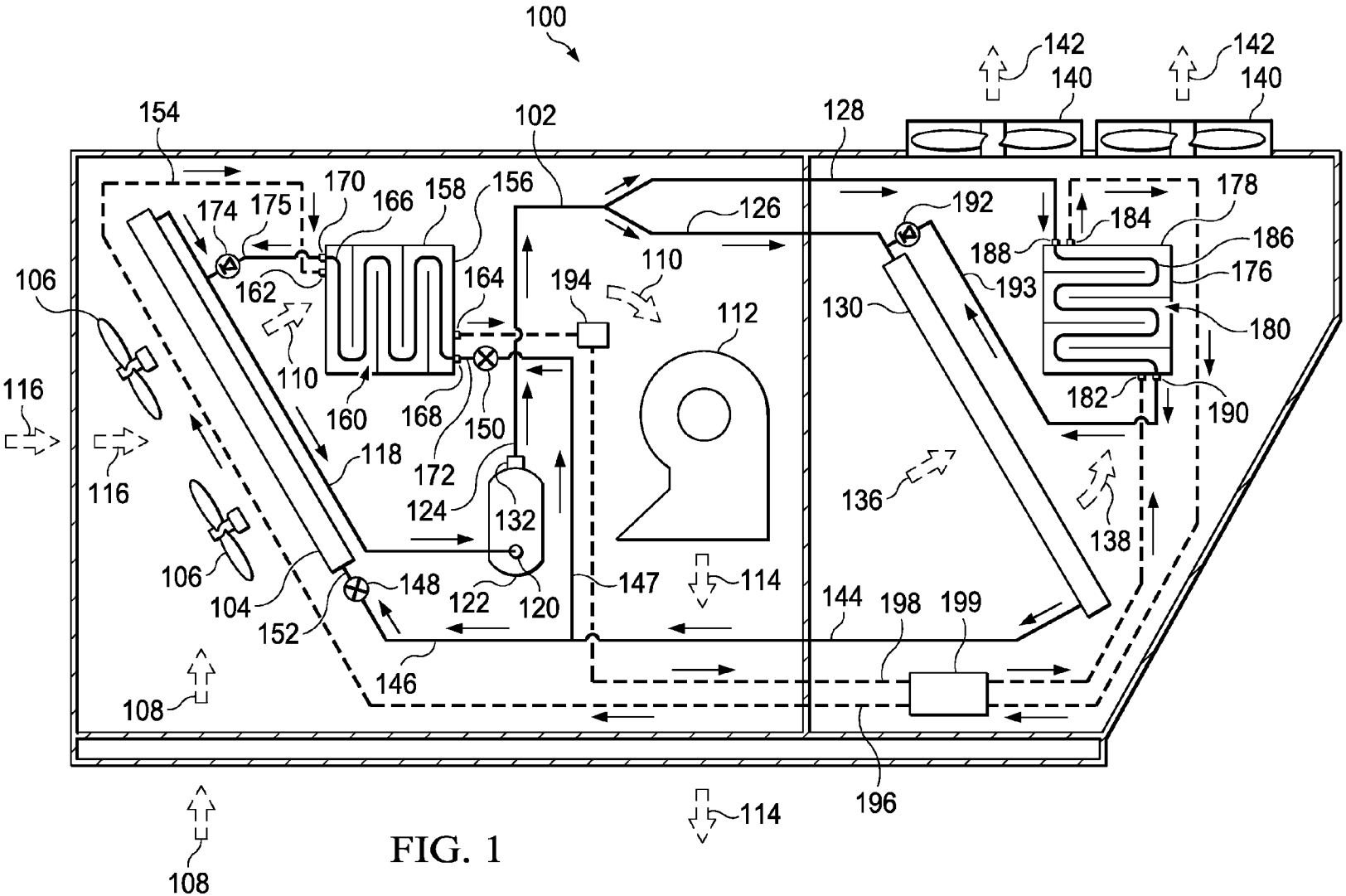
FIG. 1 is a schematic diagram of a heating, ventilating, and air conditioning system for regulating a moisture content of conditioned air, according to an illustrative embodiment.

The figures described above are only exemplary and their illustration is not intended to assert or imply any limitation with regard to the environment, architecture, design, configuration, method, or process in which different embodiments may be implemented.

DETAILED DESCRIPTION OF THE ILLUSTRATIVE EMBODIMENTS

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

In the drawings and description that follow, like parts are typically marked throughout the specification and drawings with the same reference numerals or coordinated numerals. The drawing figures are not necessarily to scale. Certain features of the illustrative embodiments may be shown exaggerated in scale or in somewhat schematic form and some details of conventional elements may not be shown in the interest of clarity and conciseness.

The embodiments described herein relate to systems, devices, and methods for regulating a moisture content of air conditioned by a heating, ventilating, and air conditioning (HVAC) system. More specifically, systems, devices, and methods are presented that enable the moisture content of conditioned air to be altered using a liquid desiccant. The liquid desiccant is disposed within a processing volume, which is substantially-enclosed as described herein. A pair of vapor-permeable membranes define opposite surfaces of the processing volume. Water vapor diffuses through the vapor-permeable membranes, thereby enabling an exchange of moisture between the liquid desiccant and the conditioned air. Because the processing volume includes the pair of vapor-permeable membranes, open exposure of the liquid desiccant, i.e., to the conditioned air, is not required to facilitate the exchange of moisture (e.g., mists, sprays, pools, etc.). In this way, the desiccant does not splash or spray in unwanted locations.

In some embodiments, the processing volume includes a refrigerant conduit to allow a transfer of heat between refrigerant flowing through the refrigerant conduit and the liquid desiccant in the processing volume. In such embodiments, the transfer of heat improves an exchange rate of moisture between the liquid desiccant and the conditioned air. Other systems, devices and methods are presented.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

As used herein, the phrases "hydraulically coupled," "hydraulically connected," "in hydraulic communication," "fluidly coupled," "fluidly connected," and "in fluid communication" refer to a form of coupling, connection, or communication related to fluids, and the corresponding flows or pressures associated with these fluids. In some embodiments, a hydraulic coupling, connection, or communication between two components describes components that are associated in such a way that fluid pressure may be transmitted between or among the components. Reference to a fluid coupling, connection, or communication between two components describes components that are associated in such a way that a fluid can flow between or among the components. Hydraulically coupled, connected, or communicating components may include certain arrangements where fluid does not flow between the components, but fluid pressure may nonetheless be transmitted such as via a diaphragm or piston.

As used herein, the terms "hot," "warm," "cool," and "cold" refer to thermal states, on a relative basis, of refrigerant within a closed-conduit refrigeration circuit. Temperatures associated with these thermal states decrease sequentially from "hot" to "warm" to "cool" to "cold". Actual temperatures, however, that correspond to these thermal states depend on a design of the closed-conduit refrigeration circuit and may vary during operation.

Now referring primarily to FIG. 1, a schematic diagram is presented of a heating, ventilating, and air conditioning (HVAC) system 100 for, among other things, regulating a moisture content of conditioned air, according to an illustrative embodiment. The HVAC system 100 includes a closed-conduit refrigeration circuit 102 for developing a cooling capacity in an evaporator 104. The closed-conduit refrigeration circuit 102 is shown in FIG. 1 by solid lines that fluidly-couple components of the closed-conduit refrigeration circuit 102, such as the evaporator 104. The solid lines represent refrigerant conduits and arrows along the solid lines indicate a flow of refrigerant, if present in the HVAC system 100. The evaporator 104 typically includes at least one fan 106 to circulate a return air 108 across one or more heat-exchange surfaces of the evaporator 104. The evaporator 104 is configured to transfer heat from the return air 108 to the refrigerant therein. The return air 108 is drawn in from a conditioned space and exits the evaporator 104 as a cooled airflow 110. A blower 112 may be present to direct the cooled airflow 110 back towards the conditioned space, thereby generating a supply air 114. In some embodiments, outdoor air 116 may be blended into the return air 108 for circulating across the one or more heat-exchange surfaces of the evaporator 104.

The closed-conduit refrigeration circuit 102 includes a suction line 118. The suction line 118 fluidly-couples the evaporator 104 to a suction port 120 of a compressor 122. The closed-conduit refrigeration circuit 102 also includes a discharge line 124, which may split to form a first branch 126 and a second branch 128. The first branch 126 of the discharge line 124 fluidly-couples a condenser 130 to a discharge port 132 of the compressor 122. The second branch 128 of the discharge line 124 will be discussed below in relation to optional components of the HVAC system 100. The condenser 130 is configured to transfer heat from refrigerant therein to the non-conditioned air 136. The non-conditioned air 136 exits the condenser 130 as a warmed airflow 138. One or more fans 140 may be present to direct the warmed airflow 138 out of the HVAC system 100, thereby producing an exhaust air 142.

The closed conduit refrigeration circuit 102 includes a liquid line 144, which may split to form a first branch 146 and a second branch 147. The first branch 146 of the liquid line 144 fluidly-couples the condenser 130 to a first expansion valve 148, or refrigerant expansion valve. The second branch 147 of the liquid line 144 fluidly-couples the condenser 130 to an optional second expansion valve 150, or desiccant-cooling expansion valve. The second branch 147 of the liquid line 144 and the second expansion valve 150 will be discussed below in relation to optional components of the HVAC system 100. The closed-conduit refrigeration circuit 102 may also include a first refrigerant line 152. The first refrigerant line 152 fluidly-couples the first expansion valve 148 to the evaporator 104. Other designs and variations are possible.

The closed-conduit refrigeration circuit 102 includes a refrigerant disposed therein. The closed-conduit refrigeration circuit 102 serves to convey refrigerant between components of the HVAC system 100 (e.g., the evaporator 104, the compressor 122, the condenser 130, etc.). Individual components of the closed-conduit refrigeration circuit 102 then manipulate the refrigerant to generate the cooled airflow 110.

In operation, the evaporator 104 receives a first cold, low-pressure liquid refrigerant from the first expansion valve 146 via the first refrigerant line 152. The first cold, low-pressure liquid refrigerant flows through the evaporator 104 and, while therein, absorbs heat from the return air 108. Such heat absorption is aided by the one or more heat-exchange surfaces of the evaporator 104. The at least one fan 106, or blower fan, enables a forced convection of return air 108 across the one or more heat-exchange surfaces of the evaporator 104. Absorption of heat by the first cold, low-pressure liquid refrigerant induces a conversion within the evaporator 104 from liquid to gas. The first cold, low-pressure liquid refrigerant therefore leaves the evaporator 104 as a warm, low-pressure gas refrigerant. Concomitantly, the return air 108 exits the evaporator 104 as the cooled airflow 110.

The warm, low-pressure gas refrigerant traverses the suction line 118 of the closed-circuit refrigeration circuit 102 and enters the suction port 120 of the compressor 122. The compressor 122 performs work on the warm, low-pressure gas refrigerant, producing a hot, high-pressure gas refrigerant that exits the compressor 122 at the discharge port 132. The hot, high-pressure gas refrigerant travels through the discharge line 124, and via the first branch 126 of the discharge line 124, enters the condenser 130. The hot, high-pressure gas refrigerant flows through the condenser 130, and while therein, transfers heat to the non-conditioned air 136. Such heat transfer is assisted by the one or more heat-exchange surfaces of the condenser 130. The at least one condenser fan 140 may enable a forced convection of non-conditioned air 136 across the one or more heat-exchange surfaces of the condenser 130. Loss of heat from the hot, high-pressure gas refrigerant induces a conversion within the condenser 130 from gas to liquid. The hot, high-pressure gas refrigerant therefore leaves the condenser 130 as a warm, high-pressure liquid refrigerant. Concomitantly, the non-conditioned air 136 exits the condenser 130 as the warmed airflow 138.

The warm, high-pressure liquid refrigerant flows through the liquid line 144, traversing the first branch 146 of the liquid line 144 to reach the first expansion valve 148. The first expansion valve 148 lowers a pressure of the warm, high-pressure liquid refrigerant passing therethrough. Such lowering of pressure simultaneously lowers a temperature of the refrigerant. The first expansion valve 148 therefore produces the cold, low-pressure liquid refrigerant (received by the evaporator 104) from the warm, high-pressure liquid refrigerant. The cold, low-pressure liquid refrigerant is circulated back into the evaporator 104 via the first refrigerant line 152.

It will be appreciated that the closed-conduit refrigeration circuit 102 circulates the refrigerant to allow repeated processing by the evaporator 104, the compressor 122, the condenser 130, and the first expansion valve 148. Repeated processing, or cycles, enables the HVAC system 100 to continuously produce the cooled airflow 110. Other components of the HVAC system 100 may be included to repeatedly process the refrigerant. As will be discussed below, conduits of the closed-conduit refrigeration circuit 102 may circulate the refrigerant through a portion of a closed-conduit desiccant circuit 154—without mixing the fluids but allowing heat transfer. Such circulation enhances an ability of the closed-conduit desiccant circuit 154 to alter a moisture content of the cooled airflow 110.

The HVAC system 100 includes the closed-conduit desiccant circuit 154 for removing at least some moisture from the cooled airflow 110 cooled by the evaporator 104. The closed-conduit desiccant circuit 154 is shown in FIG. 1 by dashed lines that fluidly-couple components of the closed-conduit desiccant circuit 154. The dashed lines represent desiccant conduits and arrows along the dashed lines indicate a flow of liquid desiccant if present in the HVAC system 100.

The closed-conduit desiccant circuit 154 includes an absorber 156. The absorber 156 has an absorber frame 158 formed with a first substantially-closed perimeter. The absorber 156 also has a pair of absorber membranes (see 204 in FIG. 2A) coupled to the absorber frame 158 along the first substantially-closed perimeter. As described in more detail below, the pair of absorber membranes (see 204 in FIG. 2A) define opposite surfaces of an absorber processing volume 160. The pair of absorber membranes are formed of a material permeable to vapor and resistant to liquids. In some embodiments, the material permeable to vapor is selected from a group including expanded polytetrafluoroethylene (ePTFE) and polydimethylsiloxane (PDMS). The absorber frame 158 has a first desiccant entry port 162 and a first desiccant exit port 164 to allow liquid desiccant to, respectively, enter and exit the absorber processing volume 160.

The closed-conduit desiccant circuit 154 may also include a first refrigerant conduit 166 disposed within the absorber processing volume 160. The first refrigerant conduit 166 has a first refrigerant entry port 168 and a first refrigerant exit port 170. The first refrigerant entry port 168 is fluidly-coupled to the second expansion valve 150 of the closed-conduit refrigeration circuit 102. The first refrigerant exit port 170 is fluidly-coupled to the suction line 118 of the closed-conduit refrigeration circuit 102.

In some embodiments, the first refrigerant entry port 168 may be fluidly-coupled to the second expansion valve 150, or desiccant expansion valve, via a second refrigerant line 172 of the closed-conduit refrigeration circuit 102. An absorber check valve 174 may be optionally included in the closed-conduit refrigerant circuit 102. If present, the absorber check valve 174 is disposed in a fluid conduit 175 between the absorber 156 and the suction line 118. The absorber check valve 174 operatively inhibits back-flow of refrigerant from the suction line 118 to the absorber 156.

The closed-conduit desiccant circuit 154 may include a desorber 176. The desorber 176 has a desorber frame 178 formed with a second substantially-closed perimeter. The desorber 176 also has a pair of desorber membranes coupled to the desorber frame 178 along the second substantially-closed perimeter. As described in more detail below, the pair of desorber membranes define opposite surfaces of a desorber processing volume 180. The pair of desorber membranes are formed of a material permeable to vapor and resistant to liquids. In some embodiments, the material permeable to vapor is selected from a group including expanded polytetrafluoroethylene (ePTFE) and polydimethylsiloxane (PDMS). The desorber frame 178 has a second desiccant entry port 182 and a second desiccant exit port 184 to allow liquid desiccant to, respectively, enter and exit the desorber processing volume 180.

The closed-conduit desiccant circuit 154 may also include a second refrigeration conduit 186 disposed within the desorber processing volume 180. The second refrigerant conduit 186 has a second refrigerant entry port 188 and a second refrigerant exit port 190. The second refrigerant entry port 188 is fluidly-coupled to the second branch 128 of the discharge line 124. The second refrigerant exit port 190 is fluidly-coupled to the condenser 130 of the closed-conduit refrigeration circuit 102. The closed-conduit refrigeration circuit 102 may optionally include a desorber check valve 192 disposed in a fluid conduit 193 between the desorber 176 and the condenser 130. If present, the desorber check valve 192 impedes back-flow of refrigerant from the condenser 130 to the desorber 176.

In some embodiments, the closed-conduit desiccant circuit 154 includes at least one pump 194 for circulating liquid desiccant therein. In such embodiments, the closed-conduit desiccant circuit 154 includes a supply line 196 fluidly-coupling the first desiccant entry port 162 of the absorber 156 to the second desiccant exit port 184 of the desorber 176. The closed-conduit desiccant circuit 154 also includes a return line 196 fluidly-coupling the first desiccant exit port 164 of the absorber 156 to the second desiccant entry port 182 of the desorber 176. Although FIG. 1 depicts the at least one pump 194 positioned along the return line 198, this depiction is not intended as limiting. Other positions along the closed-conduit desiccant circuit 154 are possible. In other embodiments, the closed-conduit desiccant circuit 154 includes a heat exchanger 199 thermally coupled to the supply line 196 and the return line 198. The heat exchanger 199 is configured to transfer thermal energy between the supply line 196 and the return line 198.

The closed-conduit desiccant circuit 154 includes a liquid desiccant disposed therein. The liquid desiccant may be in addition to the refrigerant disposed in the closed-conduit refrigeration circuit 102. The closed-conduit desiccant circuit 154 serves to convey the liquid desiccant between components of the HVAC system 100 (e.g., the absorber 156, the desorber 176, the heat exchanger 199, etc.). Individual components of the closed-conduit desiccant circuit 154 then manipulate the liquid desiccant to regulate the moisture content of the cooled airflow 110 (i.e., conditioned air). In some embodiments, the liquid desiccant includes a lithium chloride solution. Other possible liquid desiccants include, but are not limited to lithium chloride and calcium chloride.

In operation, the absorber 156 receives the cooled airflow 110 from the evaporator 104 of the closed-conduit refrigerant circuit 102. The cooled airflow 110 flows across the absorber 156 and thereby contacts exterior surfaces of the pair of absorber membranes (see 204 in FIG. 2). The absorber 156 also receives the liquid desiccant through the first desiccant entry port 162. The liquid desiccant flows within the absorber 156, i.e., within the absorber processing volume 160, and thereby contacts interior surfaces of the pair of absorber membranes. Water vapor diffuses through the pair of absorber membranes from the cooled airflow 110 into the liquid desiccant. As the liquid desiccant flows through the absorber processing volume 160, water content in the liquid desiccant progressively increases. The liquid desiccant exits the absorber 156 through the first desiccant exit port 164. Relative to the first desiccant entry port 162, the liquid desiccant at the first desiccant exit port 164 has a reduced capacity for water absorption. Such reduced capacity makes the liquid desiccant at the first desiccant exit port 164 "weak" relative to the "strong" liquid desiccant at the first desiccant entry port 162.

The return line 198 conveys the "weak" liquid desiccant from the absorber 156 to the desorber 176. The desorber 176 receives the "weak" liquid desiccant through the second desiccant entry port 182. The "weak" liquid desiccant flows within the desorber 176, i.e., within the desorber processing volume 180, thereby contacting interior surfaces of the pair of desorber membranes. Concomitantly, the desorber 176 also receives the warmed airflow 138 from the condenser 130. The warmed airflow 138 flows across the desorber 176, thereby contacting exterior surfaces of the pair of desorber membranes. Water vapor diffuses through the pair of desorber membranes, but in a direction opposite that of the absorber 156. Water vapor diffuses out of the "weak" liquid desiccant and into the warmed airflow 138. As the "weak" liquid desiccant flows through the desorber processing volume 180, water content in the "weak" liquid desiccant progressively decreases. The "weak" liquid desiccant thereby becomes "strong". The "strong" liquid desiccant exits the desorber 176 through the second desiccant exit port 184. Relative to the second desiccant entry port 182, the "strong" liquid desiccant at the first desiccant exit port 184 has an increased capacity for water absorption. The desorber 176 therefore serves to regenerate "strong" liquid desiccant from "weak" liquid desiccant.

The supply line 196 conveys the regenerated "strong" liquid desiccant from the desorber 176 to the absorber 156, thus completing the closed-conduit desiccant circuit 154. The at least one pump 194 assists the liquid desiccant in circulating through the closed-conduit desiccant circuit 154, which in turn, allows the absorber 156 and the desorber 176 to repeatedly process the liquid desiccant. Such repeated processing enables the HVAC system 100 to continuously regulate the moisture content of the cooled airflow 110. It will be appreciated that the absorber 156 and the desorber 176 provide processing volumes that substantially segregates or inhibits the liquid desiccant from ambient air outside the absorber 156 or desorber 176, but still allow an exchange of moisture. Because the processing volumes integrate vapor-permeable membranes therein, open exposure of the liquid desiccant is not required to facilitate the exchange of moisture (e.g., mists, sprays, pools, etc.).

During operation, the "strong" liquid desiccant flowing in the supply line 196 is typically hotter than the "weak" liquid desiccant flowing in the return line 198. In embodiments employing the heat exchanger 199, the heat exchanger 199 transfers heat from the "strong" liquid desiccant to the "weak" liquid desiccant. The "strong" liquid desiccant therefore experiences a decrease in temperature, and the "weak" liquid desiccant, an increase in temperature. Such alterations influence respective vapor pressures of water associated with the "strong" and "weak" liquid desiccants. Water exhibits a diminished tendency to volatilize out of the "strong" liquid desiccant and an enhanced tendency to volatilize out of the "weak" liquid desiccant. Thus, the "strong" liquid desiccant flowing through the absorber 156 may have an improved capacity for water absorption, i.e., may retain water more readily, and the "weak" liquid desiccant flowing through the desorber 176 may be easier to regenerate, i.e., may release water more readily.

As referenced previously, the closed-circuit refrigerant circuit 102 may circulate the refrigerant through a portion of the closed-circuit desiccant circuit 154. More specifically, the absorber 156 may receive the refrigerant from the second refrigerant line 172 and the desorber 176 may receive the refrigerant from the second branch 128 of the discharge line 124. Circulation of the refrigerant within the absorber 156 and the desorber 176 alters temperatures of, respectively, the "strong" liquid desiccant and the "weak" liquid desiccant. Such alterations are similar to that produced by the heat exchanger 199, if present.

For the absorber 156, warm, high-pressure liquid refrigerant from the liquid line 144 traverses its second branch 147 to reach the second expansion valve 150. In a process analogous to the first expansion valve 148, the second expansion valve 150 generates a second cold, low-pressure liquid refrigerant. The second cold, low-pressure liquid refrigerant travels through the second refrigerant line 172 and enters the absorber 156 via the first refrigerant entry port 168. The first refrigerant conduit 166 conveys the second cold, low pressure liquid refrigerant through the absorber processing volume 160. While therein, the second cold, low pressure liquid refrigerant absorbs heat from the "strong" liquid desiccant. In response, the "strong" liquid desiccant experiences a drop in temperature, thereby decreasing the vapor pressure of water associated with the "strong" liquid desiccant. The second cold, low-pressure liquid refrigerant progressively increases in temperature before exiting the absorber 156 via the first refrigerant exit port 170. Such increase in temperature may induce the cold, low-pressure liquid refrigerant to change phase, either in part or full, from liquid to gas. Refrigerant discharged from the absorber 156 is conveyed to the suction line 118 by the first fluid connection 175. The absorber check valve 174 ensures that refrigerant does not reverse flow to re-enter the absorber 156.

For the desorber 176, hot, high-pressure gas refrigerant from the discharge line 124 traverses its second branch 128 to reach the second refrigerant entry port 188. The second refrigerant conduit 186 conveys the hot, high-pressure gas refrigerant through the desorber processing volume 180. While therein, the hot, high-pressure gas refrigerant heats the desiccant, thereby increasing the vapor pressure of water associated with the "weak" liquid desiccant. The hot, high-pressure gas refrigerant progressively decreases in temperature before exiting the desorber 176 via the second refrigerant exit port 190. Refrigerant discharged from the desorber 176 is conveyed to the first branch 126 of the discharge line 124 by the second fluid connection 193. The desorber check valve 192 ensures that refrigerant does not reverse flow to re-enter the desorber 176.

In FIG. 1, refrigerant flow within the absorber processing volume 160 and the desorber processing volume 180 is depicted as flowing counter to liquid desiccant flow. However, this depiction is not intended as limiting. Other relative flows between the refrigerant and the liquid desiccant are possible.

The HVAC system 100 also includes an air-handling sub-system. The air handing sub-system moves air across a portion of the closed-conduit refrigerant circuit 102 to produce the cooled airflow 110 and across a portion of the closed-conduit desiccant circuit 154. FIG. 1 depicts the air-handling sub-system as having two fans 106, the blower 112 and two condenser fans 140. This depiction, however, is for purposes of illustration only. Other types, numbers, and positions of air-moving components are possible. The air-handling sub-system may also include ducts, vents, dampers, louvers, grills, or other air-guiding components for controlling a direction and a flow magnitude of air through the HVAC system 100 and in and to the conditioned space.

In operation, the air handling subsystem, e.g, the blower 112, draws in the return air 108 from the conditioned space, which may also be blended with the outdoor air 116, and circulates the return air 108 (or blended air) across the one or more heat-exchange surfaces of the evaporator 104. Circulation of the return air 108 across the one or more heat-exchange surfaces of the evaporator 104 enables the evaporator 104, in part, to produce the cooled airflow 110. The cooled airflow 110 continues flowing to the absorber 156. As the cooled airflow 110 circulates across one or more pairs of absorber membranes, moisture is transferred from the cooled airflow 110 into the "strong" liquid desiccant. The blower 112 then draws the cooled airflow 110 from the absorber 156 and directs the cooled airflow 110 out of the HVAC system 100. Such directed airflow becomes the return air 114, which leaves the air-handling sub-system to enter the conditioned space.

Simultaneously, the at least one condenser fan 140 flows the non-conditioned air 136 across the one or more heat exchange surfaces of the condenser 130. Flow of the non-conditioned air 136 across the one or more heat-exchange surfaces of the condenser 130 allows the condenser 130 to generate the warmed airflow 138. One or more exhaust fans 140 pull the warmed airflow 138 across the desorber 176, creating the exhaust air 142 which subsequently exits the HVAC system 100. While the warmed airflow 138 is traveling across the pair of desorber membranes, moisture is transferred into the warmed airflow 138 from the "weak" liquid desiccant.

It will be appreciated that the closed-conduit desiccant circuit 154 can function independently of the closed-conduit refrigeration circuit 102. For example, during operation of the HVAC system 100, the return air 108 may achieve a desired temperature yet still retain an undesired moisture content. In such situations, the HVAC system 100 may deactivate the closed-conduit refrigerant circuit 102 but keep the closed-conduit desiccant circuit 154 and the air-handling sub-system active. In this situation, the return air 108 (or a mixture of the return air 108 with the outdoor air 116) passes across the evaporator 104 unchanged. The cooled airflow 110 is therefore identical to the return air 108 (or the mixture). The aforementioned example, however, should not be construed as limiting of the present disclosure. Other situations are possible in which the closed-conduit desiccant circuit 154 functions independently of the closed-conduit refrigeration circuit 102.

While FIG. 1 depicts the HVAC system 100 within the context of a rooftop unit, this depiction is for purposes of illustration only. HVAC system 100 is also suitable for use in other contexts, such as a residential unit, a split-system unit, or a commercial refrigeration unit.

Figure 2B:
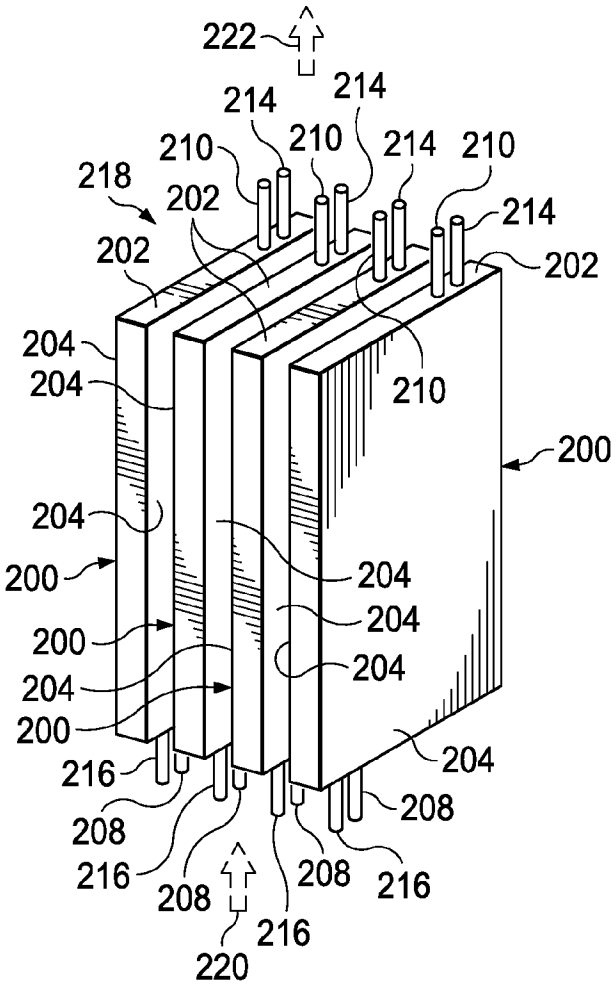
FIG. 2B is a schematic, perspective view of an array of moisture-altering devices, according to an illustrative embodiment.
Figure 2A:
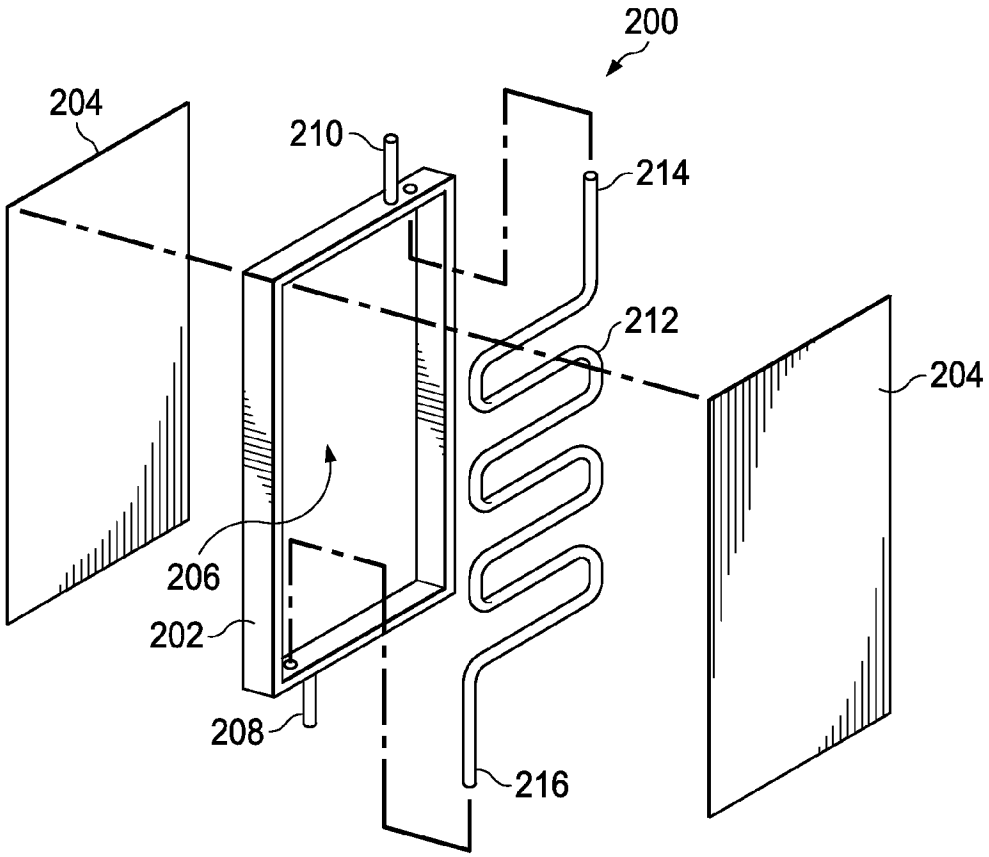
FIG. 2A is a schematic, exploded view of an illustrative embodiment a moisture-altering device for altering a moisture content of air processed by a heating, ventilating, and air conditioning (HVAC) system.

Now referring primarily to FIG. 2A, an exploded view is presented of a moisture-altering device 200 for altering a moisture content of air processed by a heating, ventilating, and air conditioning (HVAC) system, according to an illustrative embodiment. The moisture-altering device 200 of FIG. 2A may be analogous to the absorber 156, the desorber 176, or both of the HVAC system 100 described in relation to FIG. 1. The moisture-altering device 200 includes a frame 202 formed with a substantially-closed perimeter. The frame 202 is shown as a rectangle, but could take other shapes such as a circle, square, ellipse, etc. A pair of membranes 204 is coupled to the frame 202 along the substantially-closed perimeter and define opposite surfaces of a processing volume 206. The pair of membranes 204 is formed of material permeable to vapor and resistant to liquids as previously mentioned. The frame 202 has a desiccant entry port 208 and a desiccant exit port 210 configured to allow liquid desiccant to, respectively, enter and exit the processing volume 206.

The moisture-altering device 200 may include a refrigerant conduit 212 disposed within the processing volume 206. The refrigerant conduit 212 has a refrigerant entry port 214 and a refrigerant exit port 216. FIG. 1 depicts the refrigerant conduit 212 as having a serpentine shape. FIG. 1 also depicts the refrigerant entry port 214 and the refrigerant exit port 216 as being oriented such that refrigerant, during operation, flows counter to liquid desiccant. This shape and orientation, however, are not intended as limiting. The refrigeration conduit 212 could spiral or form other shapes and the orientation of the ports may be varied. The refrigerant conduit 212 may be configured to achieve a desired flow pattern within the processing volume 206 for both fluids (i.e., liquid desiccant and optional refrigerant). In some embodiments, the processing volume 206 includes at least one flow guide configured to direct a flow of liquid desiccant through the processing volume 206.

In some embodiments, the moisture-altering device 200 includes a refrigerant line coupled to the refrigerant entry port 214. In these embodiments, the refrigerant line is in fluid communication with an expansion valve of the heating, ventilating, and air conditioning system. This configuration may be operable to enhance an absorption capability of the moisture-altering device 200, such as that associated with the absorber 156 discussed in relation to FIG. 1. In some embodiments, the moisture-altering device 200 includes a discharge line coupled to the refrigerant entry port 214. In such embodiments, the discharge line is in fluid communication with a compressor of the heating, ventilating, and air conditioning system. This configuration may be operable to enhance a desorption capability of the moisture altering device 200, such as that associated with the desorber 176 discussed in relation to FIG. 1.

In operation, the liquid desiccant is disposed into the processing volume 206 through the desiccant entry port 208. The desiccant entry port 208 may be at top or bottom or any other orientation. The pair of membranes 204 allows a transport of water vapor therethrough. Moisture is thus able to exchange between the liquid desiccant in the processing volume 206 and air exterior to the processing volume 206. A net exchange of water vapor into the liquid desiccant occurs when the liquid desiccant has a greater affinity for moisture than the air. A net transport of water vapor out of the liquid desiccant occurs when the air has the greater affinity. In the former case, the moisture-altering device 200 receives moisture and functions as an absorber, and in the latter case, the moisture-altering device supplies moisture and functions as a desorber. The processing volume 206 is operable to substantially segregate the liquid desiccant from exterior air, but still allow an exchange of water vapor (i.e., moisture). Because the processing volume 206 integrates vapor-permeable membranes therein, open exposure of the liquid desiccant is not required to facilitate the exchange of water vapor (e.g., mists, sprays, pools, etc.).

The liquid desiccant may exit the processing volume 206 through the desiccant exit port 210 (or 208 depending on orientation) to start a desiccant flow. It will be appreciated that, during the desiccant flow, liquid desiccant typically flows through desiccant entry port 208 (or 210 depending on orientation) at a rate substantially matched to liquid desiccant flowing out of the desiccant exit port 210 (or 208 depending on orientation). Such matched rates allow "fresh" liquid desiccant to continuously replace liquid desiccant having a degraded capacity to alter the moisture content of air. Concomitant with the desiccant flow, air is displaced across the processing volume 206, i.e., exterior surfaces of the pair of membranes 206. Repeated displacement of air across the processing volume 206 enables the moisture-altering device 200 to alter the moisture content of air in a continuous manner.

In some embodiments, the refrigerant conduit 212 conveys the refrigerant therethrough to improve a capacity of the liquid desiccant to exchange water vapor with the air. In such embodiments, the refrigerant enters the refrigerant entry port 214 and exits the refrigerant exit port 216. If the refrigerant received by the refrigerant entry port 214 is cool relative to the liquid desiccant in the processing volume 206, heat is transferred from the liquid desiccant to the refrigerant. Such heat transfer causes a decrease in temperature of the liquid desiccant which, in turn, decreases a vapor pressure of water associated with the liquid desiccant. Water in the liquid desiccant then exhibits a diminished tendency to volatilize out of the liquid desiccant. A flow of cool refrigerant is therefore suitable when the moisture-altering device 200 functions as the absorber: the refrigerant flow, when cool relative to the liquid desiccant, improves the capacity of the liquid desiccant to retain moisture. In contrast, if the refrigerant received by the refrigerant entry port 214 is warm relative to the liquid desiccant in the processing volume 206, heat is transferred from the refrigerant to the liquid desiccant. This heat transfer causes an increase in the temperature of the liquid desiccant which, in turn, increases the vapor pressure of water associated with the liquid desiccant. Water in the liquid desiccant then exhibits an enhanced tendency to volatilize out of the liquid desiccant. A flow of warm refrigerant is therefore suitable when the moisture-altering device 200 functions as the desorber: the refrigerant flow, when warm relative to the liquid desiccant, improves the capacity of the liquid desiccant to release moisture.

The moisture-altering device 200 is not limited to a single occurrence, as suggested by FIG. 1, but may include a plurality of moisture-altering devices 200 in parallel or series. FIG. 2B presents a perspective view of an array 218 of moisture-altering devices 200, according to an illustrative embodiment. FIG. 2B depicts the array 218 as having four moisture altering devices. However, this depiction is for purposes of illustration only. Other numbers of moisture-altering devices 200 are possible. The moisture-altering devices 200 in the array 218 are spaced to allow air to flow through the array 218, and more specifically, across external surfaces of the pair of membranes 204 associated with each individual moisture-altering device 200. An incoming air 220, which may be the cooled airflow 110 described in relation to FIG. 1, flows across the pair of membranes 204 and exits as an outgoing air 222. Relative to the incoming air 220, the outgoing air 222 has an altered moisture content. If the array 218 of moisture-altering devices 200 functions as the absorber, the outgoing air 222 will have a reduced moisture content. If the array 218 of moisture altering devices 200 functions as the desorber, the outgoing air 222 will have an increased moisture content.

FIG. 2B illustrates the incoming air 220 entering a bottom of the array 218 and the outgoing air 222 exiting a top of the array 218. This illustration is not intended as limiting of the present disclosure. Other relative orientations of the incoming air 220 and the outgoing air 222, i.e., relative to the array 218 of moisture altering devices 200, are possible. FIG. 2B also depicts the pair of membranes 204 of each moisture-altering device 200 as forming a parallel, lamellar array. Other array configurations, however, are possible. For example, and without limitation, the pair of membranes 204 may be configured in each moisture-altering device 200 to form a concentric, cylindrical array.

According to an illustrative embodiment, a method of regulating a moisture content of air conditioned by a heating, ventilating, and air conditioning system includes the step of flowing a liquid desiccant within an absorber processing space. The absorber processing space is formed by an absorber frame, a first absorber membrane, and a second absorber membrane. The liquid desiccant contacts a first side of the first absorber membrane and a first side of the second absorber membrane. The first side of the first absorber membrane and the first side of the second absorber membrane may be interior surfaces of the absorber processing space. The first absorber membrane and the second absorber membrane are formed of material permeable to vapor and resistant to liquids.

The method also includes the step of flowing a conditioned air onto at least a second side of the first absorber membrane or a second side of the second absorber membrane. The second side of the first absorber membrane and the second side of the second absorber membrane may be exterior surfaces of the absorber processing space. The method involves the step of transporting water vapor through the first absorber membrane and the second absorber membrane from the second side to the first side of each membrane. The step of transporting forms a diluted liquid desiccant from the liquid desiccant. The diluted liquid desiccant has an increased water content relative to the liquid desiccant. In some embodiments, the method also involves the step of cooling the liquid desiccant with refrigerant received from an expansion valve of the heating, ventilating, and air conditioning system. The step of cooling occurs concomitant with the step of transporting water vapor through the first absorber membrane and the second absorber membrane from the second side to the first side of each membrane.

In some embodiments, the method includes the step of flowing a diluted liquid desiccant within a desorber processing space. The desorber processing space is formed by a desorber frame, a first desorber membrane, and a second desorber membrane. The diluted liquid desiccant contacts a first side of the first desorber membrane and a first side of the second desorber membrane. The first side of the first desorber membrane and the first side of the second desorber membrane may be interior surfaces of the desorber processing space. The first desorber membrane and the second desorber membrane are formed of material permeable to vapor.

The method also includes the step of flowing a non-conditioned air on at least a second side of the first desorber membrane or a second side of the second desorber membrane. The second side of the first desorber membrane and the second side of the second desorber membrane may be exterior surfaces of the desorber processing space. The method involves the step of transporting water vapor through the first desorber membrane or the second desorber membrane from the second side to the first side of each membrane. The step of transporting regenerates the liquid desiccant from the diluted liquid desiccant. In some embodiments, the method also involves the step of heating the liquid desiccant using refrigerant discharged from a compressor of the heating, ventilating, and air conditioning system. The step of heating may occur concomitant with the step of transporting water vapor through the first desorber membrane and the second desorber membrane from the second side to the first side of each membrane.

In illustrative embodiments, the desiccant is cooled while it is absorbing and heated while it is desorbing by the refrigerant circuit itself. In these embodiments, no dedicated, separate water chiller is required.

Although the present invention and its advantages have been disclosed in the context of certain illustrative, non-limiting embodiments, it should be understood that various changes, substitutions, permutations, and alterations can be made without departing from the scope of the invention as defined by the appended claims. It will be appreciated that any feature that is described in connection to any one embodiment may also be applicable to any other embodiment.

It will be understood that the benefits and advantages described above may relate to one embodiment or may relate to several embodiments. It will further be understood that reference to "an" item refers to one or more of those items.

The steps of the methods described herein may be carried out in any suitable order or simultaneous where appropriate. Where appropriate, aspects of any of the examples described above may be combined with aspects of any of the other examples described to form further examples having comparable or different properties and addressing the same or different problems.

It will be understood that the above description of the embodiments is given by way of example only and that various modifications may be made by those skilled in the art. The above specification, examples, and data provide a complete description of the structure and use of exemplary embodiments of the invention. Although various embodiments of the invention have been described above with a certain degree of particularity, or with reference to one or more individual embodiments, those skilled in the art could make numerous alterations to the disclosed embodiments without departing from the scope of the claims.

I claim:

1. A heating, ventilating, and air conditioning system for regulating a moisture content of conditioned air, the system comprising: a closed-conduit refrigeration circuit for developing cooling capacity in an evaporator, the closed-circuit refrigeration circuit comprising a refrigerant expansion valve and a suction line; a closed-conduit desiccant circuit for removing at least some moisture from a cooled airflow cooled by the evaporator, the closed-conduit desiccant circuit having an absorber, the absorber comprising: an absorber frame formed with a first substantially-closed perimeter, a pair of absorber membranes coupled to the absorber frame along the first substantially-closed perimeter, the pair of absorber membranes defining opposite surfaces of an absorber processing volume, the pair of absorber membranes formed of a material permeable to vapor and resistant to liquids, and wherein the absorber frame has a first desiccant entry port and a first desiccant exit port configured to allow liquid desiccant to, respectively, enter and exit the absorber processing volume; fan or blower for moving air across a portion of the closed-conduit refrigeration circuit to produce the cooled air flow and across a portion of the closed-conduit desiccant circuit; and wherein a portion of the closed-conduit refrigeration circuit enters the absorber processing volume for cooling desiccant therein; and wherein the closed-conduit refrigeration circuit and the absorber further comprise: a first refrigerant conduit disposed within the absorber processing volume, the first refrigerant conduit having a first refrigerant entry port and a first refrigerant exit port; wherein the first refrigerant entry port is fluidly-coupled to the expansion valve of the closed-conduit refrigeration circuit; and wherein the first refrigerant exit port is fluidly-coupled to the suction line of the closed-conduit refrigeration circuit.

2. The system of claim 1, wherein the closed-circuit desiccant circuit further comprises a desorber, the desorber comprising:

a desorber frame formed with a second substantially-closed perimeter;

a pair of desorber membranes coupled to the desorber frame along the second substantially-closed perimeter, the pair of desorber membranes defining opposite surfaces of a desorber processing volume, the pair of desorber membranes formed of a material permeable to vapor and resistant to liquids; and wherein the desorber frame has a second desiccant entry port and a second desiccant exit port configured to allow liquid desiccant to, respectively, enter and exit the desorber processing volume.

3. The system of claim 1, wherein the closed-circuit desiccant circuit further comprises a desorber, the desorber comprising:

a desorber frame formed with a second substantially-closed perimeter;

a pair of desorber membranes coupled to the desorber frame along the second substantially-closed perimeter, the pair of desorber membranes defining opposite surfaces of a desorber processing volume, the pair of desorber membranes formed of a material permeable to vapor and resistant to liquids;

wherein the desorber frame has a second desiccant entry port and a second desiccant exit port configured to allow liquid desiccant to, respectively, enter and exit the desorber processing volume;

a second refrigerant conduit disposed within the desorber processing volume, the second refrigerant conduit having a second refrigerant entry port and a second refrigerant exit port;

wherein the second refrigerant entry port is fluidly-coupled to a discharge line of the closed-conduit refrigeration circuit; and wherein the second refrigerant exit port is fluidly-coupled to a condenser of the closed-conduit refrigeration circuit.

4. The system of claim 1, wherein the closed-circuit desiccant circuit further comprises a desorber, the desorber comprising:

a desorber frame formed with a second substantially-closed perimeter;

a pair of desorber membranes coupled to the desorber frame along the second substantially-closed perimeter, the pair of desorber membranes defining opposite surfaces of a desorber processing volume, the pair of desorber membranes formed of a material permeable to vapor and resistant to liquids;

wherein the desorber frame has a second desiccant entry port and a second desiccant exit port configured to allow liquid desiccant to, respectively, enter and exit the desorber processing volume; and wherein the closed-conduit desiccant circuit comprises:

at least one pump for circulating liquid desiccant therein, a supply line fluidly-coupling the first desiccant entry port of the absorber to the second desiccant exit port of the desorber, a return line fluidly-coupling the first desiccant exit port of the absorber to the second desiccant entry port of the desorber.

5. The system of claim 1, wherein the closed-circuit desiccant circuit further comprises a desorber, the desorber comprising:

a desorber frame formed with a second substantially-closed perimeter;

a pair of desorber membranes coupled to the desorber frame along the second substantially-closed perimeter, the pair of desorber membranes defining opposite surfaces of a desorber processing volume, the pair of desorber membranes formed of a material permeable to vapor and resistant to liquids; and wherein the desorber frame has a second desiccant entry port and a second desiccant exit port configured to allow liquid desiccant to, respectively, enter and exit the desorber processing volume; and wherein the closed-conduit desiccant circuit comprises:

at least one pump for circulating liquid desiccant therein;

a supply line fluidly-coupling the first desiccant entry port of the absorber to the second desiccant exit port of the desorber, a return line fluidly-coupling the first desiccant exit port of the absorber to the second desiccant entry port of the desorber, and a heat exchanger thermally-coupled to the supply line and the return line for transferring thermal energy between the supply line and the return line.

6. The system of claim 1, comprising a refrigerant disposed in the closed-circuit refrigerant circuit and a liquid desiccant disposed in the closed-circuit desiccant circuit.

7. The system of claim 1, comprising a refrigerant disposed in the closed-circuit refrigerant circuit and a liquid desiccant disposed in the closed-circuit desiccant circuit, and wherein the liquid desiccant comprises a lithium chloride solution.

8. The system of claim 1, wherein the material permeable to vapor and resistant to liquid comprises a material formed of expanded material comprises one of a group comprising polytetrafluoroethylene and polydimethylsiloxane.

9. An moisture-altering device for altering a moisture content of air processed by a heating, ventilating, and air conditioning system, the device comprising: a frame formed with a substantially-closed perimeter; a pair of membranes coupled to the frame along the substantially-closed perimeter, the pair of membranes defining opposite surfaces of a processing volume, the pair of membranes formed of a material permeable to vapor and resistant to liquid; a refrigerant conduit disposed within the processing volume, the refrigerant conduit having a refrigerant entry port and a refrigerant exit port; and wherein the frame has a desiccant entry port and a desiccant exit port configured to allow liquid desiccant to, respectively, enter and exit the processing volume; and further comprising a refrigerant line coupled to the refrigerant entry port, the refrigerant line in fluid communication with a refrigerant expansion valve of the system.

10. The device of claim 9, further comprising a discharge line coupled to the refrigerant entry port, the discharge line in fluid communication with a compressor of the system.

11. The device of claim 9, further comprising a liquid desiccant disposed within the processing volume.

12. The device of claim 11, wherein the liquid desiccant comprises a lithium chloride solution.

13. The device of claim 11, further comprising a refrigerant disposed within the refrigerant conduit.

14. The device of claim 9, wherein the processing volume comprises at least one fluid guide configured to direct a flow of liquid desiccant through the processing volume.

15. A method of regulating a moisture content of air conditioned by a heating, ventilating, and air conditioning system, the method comprising: flowing a liquid desiccant within an absorber processing space, the absorber processing space formed by an absorber frame and a first absorber membrane and a second absorber membrane, the liquid desiccant contacting a first side of the first absorber membrane and a first side of the second absorber membrane; flowing a conditioned air onto at least a second side of the first absorber membrane and a second side of the second absorber membrane; transporting water vapor through the first absorber membrane and the second absorber membrane from the second side to the first side of each membrane; and wherein the first absorber membrane and the second absorber membrane are formed of a material permeable to vapor; and wherein the step of transporting forms a diluted liquid desiccant from the liquid desiccant; and further comprising: cooling the liquid desiccant with refrigerant received from an expansion valve of the system and heating the liquid desiccant using refrigerant discharged from a compressor of the system.

16. The method of claim 15, further comprising:

flowing a diluted liquid desiccant within a desorber processing space, the desorber processing space formed by a desorber frame a first desorber membrane and a second desorber membrane, the diluted liquid desiccant contacting a first side of the first desorber membrane and a first side of the second desorber membrane;

flowing a non-conditioned air on at least a second side of the first desorber membrane or a second side of the second desorber membrane;

transporting water vapor through the first desorber membrane and the second desorber membrane from the first side to the second side of each membrane;

wherein the first desorber membrane and the second desorber membrane are formed of a material permeable to vapor; and wherein the step of transporting regenerates the liquid desiccant from the diluted liquid desiccant.

* * * * *